US005336819A

United States Patent [19]

McAuliffe et al.

[11] Patent Number: 5,336,819

[45] Date of Patent: Aug. 9, 1994

[54] LIQUEFACTION OF CELLULOSE

[75] Inventors: Charles A. McAuliffe; Frederick R. Benn, both of Manchester, England

[73] Assignee: Man-Oil Limited, Manchester, United Kingdom

[21] Appl. No.: 897,567

[22] Filed: Jun. 11, 1992

Related U.S. Application Data

[63] Continuation-in-part of Ser. No. 382,654, filed as PCT/GB88/00058, Feb. 1, 1988, published as WO88/05807, Aug. 11, 1988.

[30] Foreign Application Priority Data

Jan. 1, 1987 [UK] United Kingdom ..... 8702199

[51] Int. Cl.[5] ..... C07C 1/00; C07C 4/00

[52] U.S. Cl. ..... 585/240; 585/242; 208/400; 423/DIG. 18

[58] Field of Search ..... 585/240, 242; 208/400

[56] References Cited

U.S. PATENT DOCUMENTS

| | | | |
|---|---|---|---|
| 3,864,097 | 2/1975 | Urban | 585/242 |
| 4,052,292 | 10/1977 | Espenscheid et al. | 585/242 |
| 4,266,083 | 5/1981 | Huang | 585/240 |
| 4,618,736 | 10/1986 | Benn et al. . | |

OTHER PUBLICATIONS

Abstract EP0182309 from German Patent 3,442,506.

*Primary Examiner*—Asok Pal

*Attorney, Agent, or Firm*—Salter & Michaelson

[57] ABSTRACT

The conversion of cellulose to hydrocarbon fuel, particularly fuel oil can be carried out using a polycyclic hydrogen donor substance. The present invention rests on the discovery that a light cut of the product oil can be used in place of the polycyclic hydrogen donor substance thus making it much easier to run the process continuously.

9 Claims, No Drawings

LIQUEFACTION OF CELLULOSE

This is a continuation-in-part of application Ser. No. 07/382,654 filed as PCT/GB00058, Feb. 1, 1988 and published as WO88/05807, Aug. 11, 1988, now abandoned.

This invention relates to the liquefaction of cellulose.

U.K. Patent Specification No.2089831 describes a process for liquefaction of cellulose which comprises hydrogenation of the cellulose in the presence of a polycyclic hydrogen donor substance such as tetralin at elevated temperature and increased pressure. The product comprises a mixture of solid, liquid and gaseous hydrocarbons. The polycyclic hydrogen donor substance is recovered and used in the treatment of further cellulose.

It has now been discovered that the liquefaction of cellulose can be effected by replacing the polycyclic hydrogen donor substance with cellulose derived oil.

According to the invention there is provided a process for converting cellulose to hydrocarbon comprising subjecting the cellulose to elevated pressure and temperature in the presence of a liquefaction solvent characterised in that during at least part of the process the liquefaction solvent is wholly a cellulose derived oil.

Further, the process of converting cellulose is carried out without the addition of water or the use of additional reducing species, such as a specific hydrogen donor solvent or a reducing gas. In this regard, it has even been found that in actual practice, the addition of a reducing gas can have a deleterious effect on the process by causing improper mixing and irregular flow through process vessels due to slugging and surging.

By the invention, therefore, the requirement for addition of a specific polycyclic hydrogen donor solvent is rendered unnecessary and hence the separation of polycyclic hydrogen donor solvent from the product is no longer required. In a preferred embodiment of the invention a part of the liquid aromatic hydrocarbon product oil from the process is used for the treatment of further cellulose. Thus the invention can very easily be operated continuously in which a predetermined quantity of product oil is recycled for the treatment of fresh cellulose. It will be understood, however, that, even in a continuous process, the cellulose derived oil used in the invention does not have to be recycled from the product of the process actually being operated. The cellulose derived oil can, if desired, be taken from another suitable source. For example the oil can be obtained from another like process according to the present invention or a process as described in U.K. Patent Specification No.2089831.

In order to reach a state of affairs where it is possible to carry out the process of the present invention, should cellulose derived oil not be available, it may be necessary to carry out the process as described in U.K. Patent Specification No.2089831 and utilise a polycyclic hydrogen donor substance until sufficient product oil has been obtained. In this embodiment of the invention product oil together with polycyclic hydrogen donor substance can be used. The proportions of polycyclic hydrogen donor substance to cellulose derived oil do not appear to be critical. Thus starting from a process using a polycyclic hydrogen donor substance the proportion of cellulose derived oil in the recycle for treatment of fresh cellulose can be progressively increased with corresponding reduction of the proportion of polycyclic hydrogen donor substance until the recycle consists entirely of product oil.

It is preferred that the cellulose derived oil used in the invention should comprise a light fraction of the liquid oil product obtained from cellulose by distillation, in particular a cut from 200° to 300° at atmospheric pressure. Although this is preferred, it is not necessary that the cellulose derived oil should consist entirely of a fraction in this range. It is not even essential that the composition of the cellulose derived oil used as starting material should remain uniform during the process. For example when the process is operated using recycled product oil it may happen that the proportion of light oil in the recycled oil gradually falls. When the performance of the recycled oil reaches an unacceptable level, for example if the oil becomes too viscous to handle, the proportion of light oil in the recycled oil can be increased by any suitable means.

The cellulose material for use in the invention can be derived from any source. Examples include cellulosic material from municipal refuse and waste biomass such as straw and sugar cane.

The process of the invention is preferably carried out in the presence of a catalyst- The preferred catalysts are heterogeneous catalysts such as nickel.

As stated previously the process of the invention is carried out at elevated temperature and increased pressure. The preferred temperature range is from 320° to 380° C. particularly preferred 350° C. and pressure would be 40.53 to 151.99 Bar (40 to 150 atmospheres).

The following Examples further illustrates the invention.

EXAMPLE I 100 grams of cellulosic material from municipal refuse were charged to a pressure vessel together with 400 grams of cellulose derived oil and 2 grams of catalyst. Air was exhausted from the vessel which was then heated to 350° C. over a period of three hours and that temperature maintained for a further two hours. A pressure of 151.99 Bar (150 atmospheres) developed in the vessel.

The vessel was then cooled. The reaction products were as follows:

| | |
|---|---|
| Solids (char) | 2 g |
| Oil | 433 g |
| Gas (including steam) | 65 g |

For continuous operation, therefore, 400 g of oil can be taken from the oil product and recycled for treating a further 100 g of cellulosic material. If the 400 g recycle contains too high a proportion of heavy oils the product oil can be distilled and 400 grams of a light cut recycled.

EXAMPLE II 100 grams of cellulosic material from sugar cane bagasse were charged to a pressure vessel together with 390 grams of cellulose derived oil and 2 grams of catalyst. Air was exhausted from the vessel which was then heated to 380° C. over a period of three and a half hours and that temperature maintained for a further two hours. A pressure of 177.32 Bar (175 atmospheres) developed in the vessel.

The vessel was then cooled. The reaction products were as follows:

| | |
|---|---|
| Solids (char) | 7 g |
| Oil | 415 g |
| Gas (including steam) | 68 g |

EXAMPLE III 90 grams of cellulosic material from straw were charged to a pressure vessel together with 390 grams of cellulose derived oil and 1 gram of catalyst. Air was exhausted from the vessel which was then heated to 375° C. over a period of three hours and that temperature maintained for a further one hour. A pressure of 7.18 Bar (165 atmospheres) developed in the vessel.

The vessel was then cooled. The reaction products were as follows:

| | |
|---|---|
| Solids (char) | 7 g |
| Oil | 415 g |
| Gas (including steam) | 59 g |

This Example also illustrates a process which can readily be run continuously by recycling 390 g of product oil for treating a further 100 g of straw derived cellulosic material.

We claim:

1. A process for converting cellulose to hydrocarbon product comprising subjecting the cellulose to a temperature of from 320° to 380° C. and a pressure of at least 40 atmospheres in the presence of a nickel catalyst and a cellulose derived oil without the use of any additional reducing species to produce said hydrocarbon product; said cellulose derived oil being obtained from said hydrocarbon product.

2. A process as claimed in claim 1, characterised in that the hydrocarbon product oil is recycled for treatment with further cellulose in a continuous process.

3. A process for converting cellulose to hydrocarbon comprising subjecting the cellulose to a temperature of from 320° to 380° C. and a pressure of at least 40 atmospheres in the presence of a nickel catalyst and a cellulose derived oil without the use of any additional reducing species, said cellulose derived oil comprising a light fraction.

4. A process for converting cellulose to hydrocarbon comprising subjecting the cellulose to a temperature of from 320° to 380° C. and a pressure of between 40 atmospheres and 150 atmospheres in the presence of a nickel catalyst and a cellulose derived oil without the use of any additional reducing species.

5. Hydrocarbon obtained from the process as claimed in claim 4.

6. A continuous process for converting cellulosic material to hydrocarbon fuel oil comprising subjecting the cellulosic material to a temperature of from 320° to 380° C. and a pressure of at least 40 atmospheres in the presence of a nickel catalyst and a cellulose derived aromatic liquefaction solvent to produce a hydrocarbon product, separating aromatic hydro-carbon oil from the hydrocarbon product and recycling at least a portion of said separated aromatic oil for use thereof as said aromatic solvent, said portion of said aromatic oil being recycled with further cellulose.

7. A process for converting cellulosic material to hydrocarbon fuel oil comprising subjecting the cellulosic material to a temperature of from 320° to 380° C. and a pressure of at least 40 atmospheres in the presence of a nickel catalyst and a cellulose derived aromatic liquefaction solvent to produce a hydrocarbon product, separating aromatic hydro-carbon oil from the hydrocarbon product and recycling at least a portion of said separated aromatic oil for use thereof as said aromatic solvent, the recycled portion of said separated aromatic oil comprising a distillation fraction of said separated oil cut from 200° C. to 300° C. at atmospheric pressure.

8. A process for converting cellulosic material to hydrocarbon fuel oil comprising subjecting the cellulosic material to a temperature of from 320° to 380° C. and a pressure of between 40 atmospheres and 150 atmospheric in the presence of a nickel catalyst and a cellulose derived aromatic liquefaction solvent to produce a hydrocarbon product, separating aromatic hydro-carbon oil from the hydrocarbon product and recycling at least a portion of said separated aromatic oil for use thereof as said aromatic solvent.

9. The hydrocarbon oil product produced by the method of claim 8.

* * * * *